US010295202B2

(12) United States Patent
Hijazi

(10) Patent No.: US 10,295,202 B2
(45) Date of Patent: May 21, 2019

(54) SAIL SWITCH FOR MONITORING AIR FLOW

(71) Applicant: Ali Yahya Hijazi, Baltimore, MD (US)

(72) Inventor: Ali Yahya Hijazi, Baltimore, MD (US)

( * ) Notice: Subject to any disclaimer, the term of this patent is extended or adjusted under 35 U.S.C. 154(b) by 714 days.

(21) Appl. No.: 14/824,076

(22) Filed: Aug. 12, 2015

(65) Prior Publication Data

US 2017/0045248 A1 Feb. 16, 2017

(51) Int. Cl.
*F24F 1/06* (2011.01)
*H01H 35/24* (2006.01)

(52) U.S. Cl.
CPC ..... *F24F 1/06* (2013.01); *H01H 35/24* (2013.01)

(58) Field of Classification Search
CPC ..... F24F 1/06; H01H 35/24
USPC ..... 700/276
See application file for complete search history.

(56) References Cited

U.S. PATENT DOCUMENTS 3,628,346 A * 12/1971 Lagrone, Jr. ..... F24F 11/00 62/126
3,890,579 A * 6/1975 Carlson ..... F23N 5/123 327/193
3,974,699 A * 8/1976 Morris ..... E02F 3/764 172/4.5
4,589,331 A * 5/1986 Villamagna ..... F24F 11/0001 454/239
4,725,700 A * 2/1988 Zoludow ..... G01P 13/0033 200/302.1
6,449,876 B1 * 9/2002 Pursell ..... D06F 58/02 34/108
6,464,000 B1 * 10/2002 Kloster ..... F24H 9/2085 165/247
7,900,849 B2 * 3/2011 Barton ..... G05D 23/1905 236/51
2011/0160914 A1 * 6/2011 Kennett ..... F24F 13/14 700/276

(Continued)

OTHER PUBLICATIONS

Dwyer Instruments, Model 530 Air Flow Switch Specifications Manual, 2014, Dwyer Instruments, FR# 2C-440532-00 Rev. 4 (Year: 2014).*

(Continued)

*Primary Examiner* — Robert E Fennema
*Assistant Examiner* — Christopher W Carter
(74) *Attorney, Agent, or Firm* — Rahman LLC

(57) ABSTRACT

A sail switch for sensing air flow and responsively opening and closing a control circuit, the sail switch comprising a mounting base, a sail member, an arm supporting the sail member to the mounting base at a predetermined orientation thereto, an adjustable joint capable of varying orientation of the sail to the mounting base, and an electrical switch. The sail switch may have an orientation sensor and readout, a pilot light annunciating switch closure or opening, a time delay relay inhibiting control circuit shutdown, a thermostatic device monitoring air temperature, a communications feature transmitting sensed temperatures, an actuator for operating a supplementary cooling system, switch loading adjustability arranged to adjust force required to displace the sail member, a switch arm travel adjustment feature constraining range of travel of the sail member, a control circuit on-off switch, a transformer, a DC to AC inverter, and an AC to DC converter.

20 Claims, 6 Drawing Sheets

(56) References Cited

U.S. PATENT DOCUMENTS

2013/0068915 A1* 3/2013 Yang ..... F16M 11/041
248/551

OTHER PUBLICATIONS

Honeywell, S688A Sail Switch Specifications Manual, Honeywell Inc., 1991, Rev. 9-91 (Year: 1991).*
K&J Magnetics, Inc., MMWR-B-Y0 Mounting Magnet, Aug. 18, 2014 (Year: 2014).*

* cited by examiner

SAIL SWITCH FOR MONITORING AIR FLOW

FIELD OF THE INVENTION

The present invention relates to sail switches used for monitoring fluid flow.

BACKGROUND OF THE INVENTION

Heating, ventilating, and air conditioning (HVAC) systems have long used sail switches to sense air flow. Sail switches are conventionally mounted inside ductwork which conducts air in HVAC systems. Components of HVAC systems which handle air may not be enclosed in ductwork, housings, and the like, may require monitoring of air flow therethrough to maintain efficient operation and avoid catastrophic component failure. An example is a condenser of an air conditioning system. Condensers are usually located outdoors, where they are susceptible to full or partial clogging by leaves, trash, and other contaminants. Significant obstruction of air flow by contaminants leads to inadequate cooling of refrigerant within the condenser.

Air flow through condensers has been monitored inferentially. That is, typically, a sensor such as a temperature sensor is located at a selected point along a conduit conducting refrigerant which has been cooled in the condenser. If the refrigerant has not been sufficiently cooled, lack of sufficient air flow, a frequent cause of inadequate cooling of refrigerant, may reasonably be suspected.

Inferential sensing of condenser obstruction is not unreasonable. However, other causes of inadequate cooling of refrigerant may be present, thereby causing inferred failure of air flow to be spuriously reported. Also, sensors placed in a refrigerant line are subject to inaccuracy and leaks.

Sail switches used in other applications are subject to being ineffectively located within an air stream. This may be, for example, because a suitable mounting location for a sail switch may not be in accord with the best placement of the sail switch.

A need remains for improving effectiveness and versatility of sail switches.

SUMMARY OF THE INVENTION

The present invention addresses the above stated situation by providing a sail switch which is positionally adjustable relative to its mounting. The novel sail switch includes an adjustable joint between the sail itself and the mounting.

Also, the novel sail switch may include additional features which improve versatility thereof, such as, among others, angular orientation readout, air temperature sensor mounted directly on the sail, adjustability to deflection of the sail, and adjustment of the amount of air flow which will cause the sail switch to operate.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
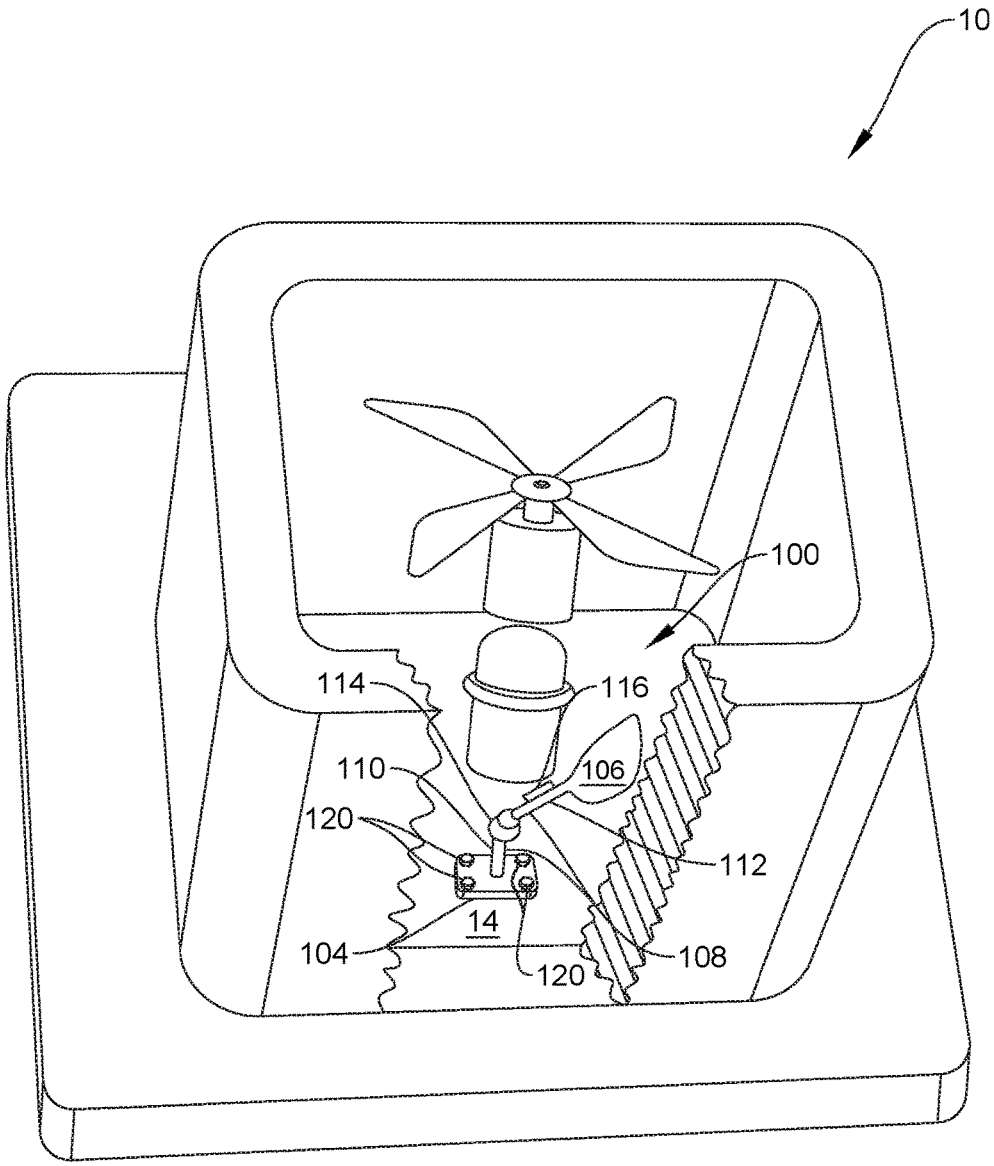
FIG. 1 is a schematic perspective environmental view of a sail switch mounted in a condenser, broken away to reveal internal detail, according to at least one aspect of the invention.

Referring first to FIG. 1, according to at least one aspect of the invention, there is shown an outdoor condenser 10 which is part of a split system residential air conditioning unit or heat pump (neither shown in their entirety). Condenser 10 includes a sail switch 100 for sensing air flow and responsively opening and closing a control circuit 12A (FIG. 4), a mounting base 104, a sail member 106, and an arm 108 supporting sail member 106 to mounting base 104 at a predetermined orientation thereto. Arm 108 includes a fixed segment 110, an adjustable segment 112, and a joint 114 between fixed segment 110 and adjustable segment 112. Sail switch 100 also includes an electrical switch 116 mounted on one of adjustable segment 112 of arm 108 and sail member 106. Control circuit 12A may be electrically connected to and controlled by sail switch 100.

In a split system air conditioner or heat pump, an evaporator and air handler (neither shown) are located indoors, remote from condenser 10. It should be stressed that the arrangement described herein is representative only. That is, condenser 10 could be part of a unitary package HVAC unit, part of a non-residential HVAC unit, or part of other systems which are not necessarily residential split system HVAC components.

Figure 2:
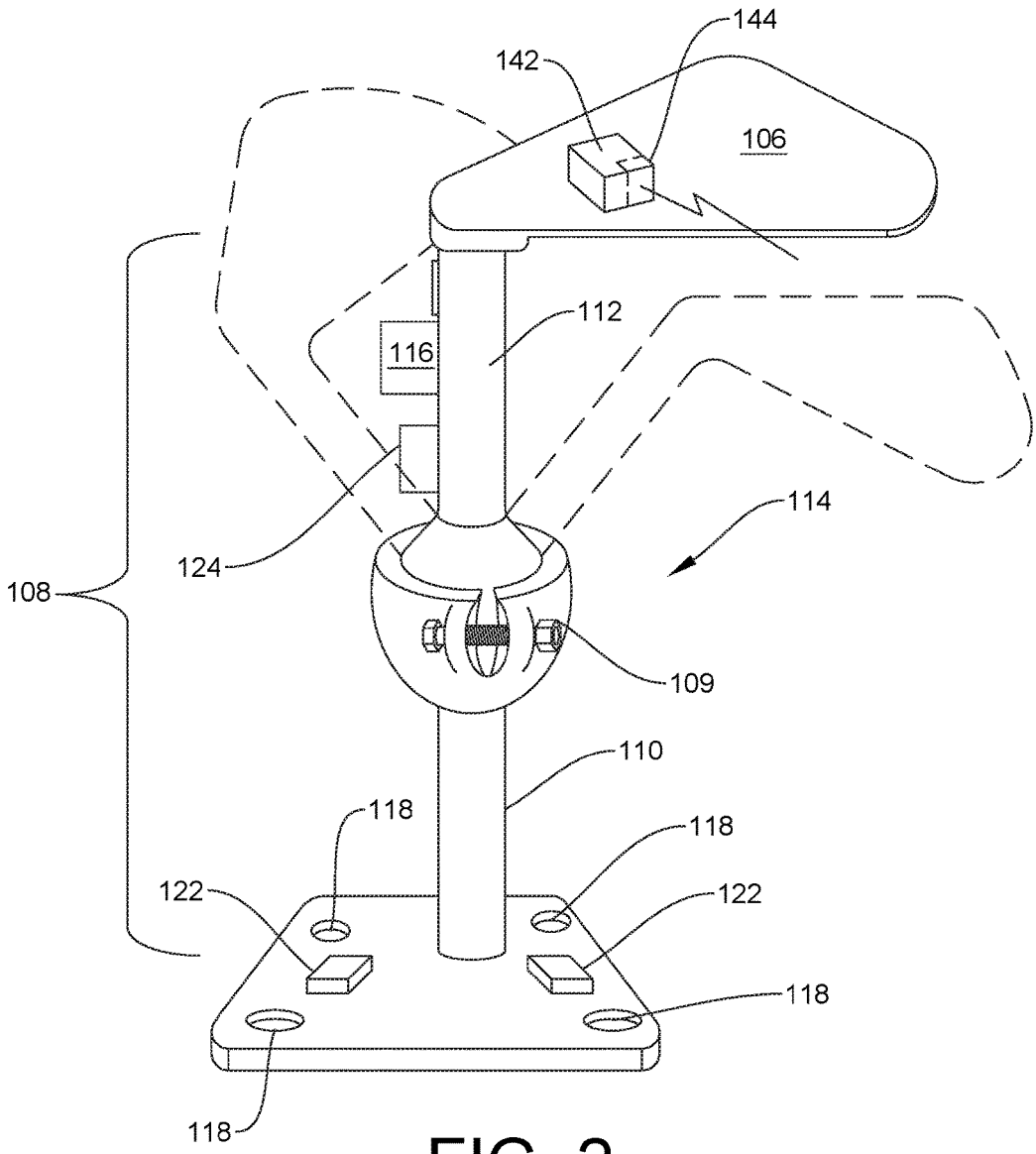
FIG. 2 is a schematic perspective view of the sail switch of FIG. 1, according to at least one aspect of the invention.
Figure 3:
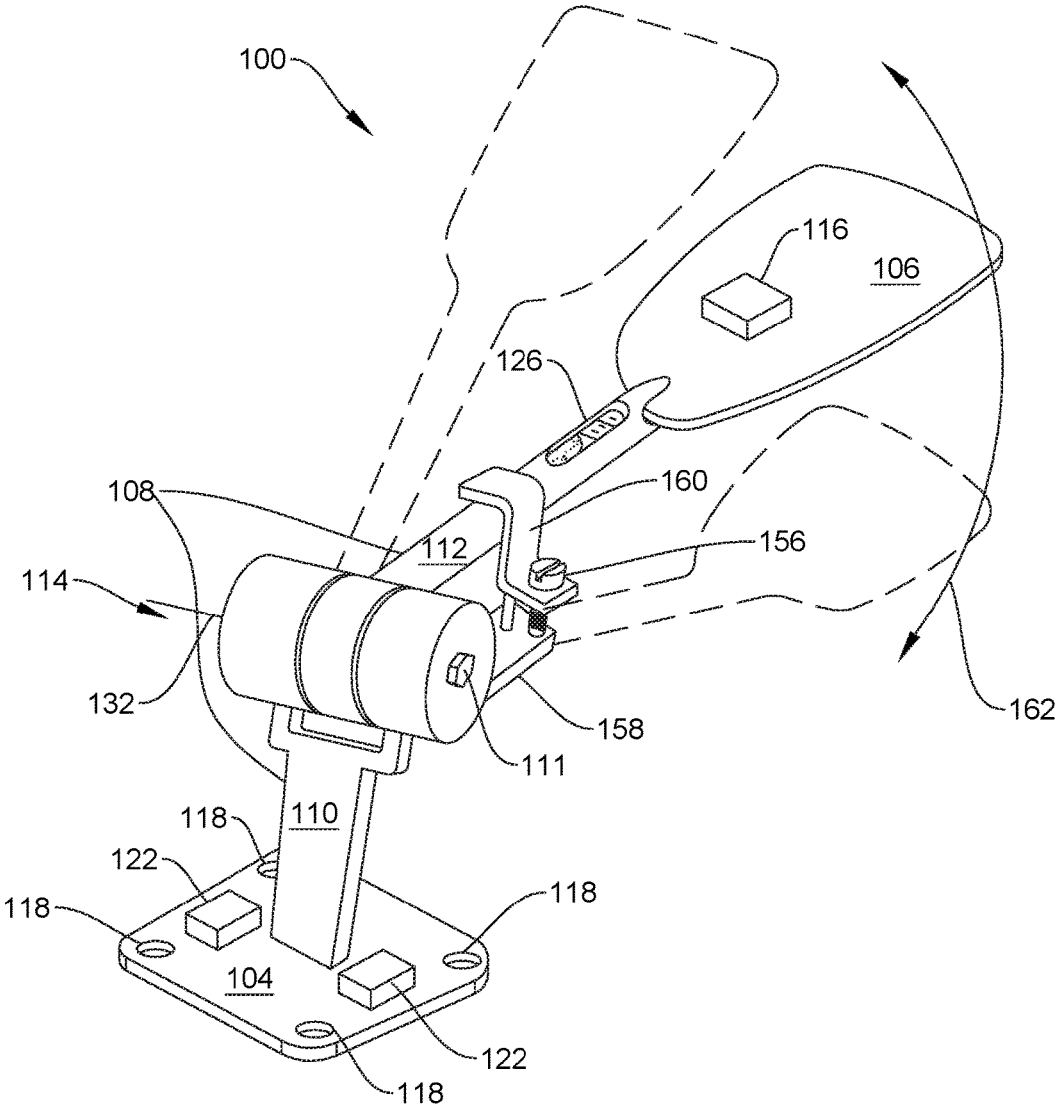
FIG. 3 is a schematic perspective view of an alternative to the sail switch of FIG. 2, according to at least one aspect of the invention.

In FIG. 2, electrical switch 116 is mounted on adjustable segment 112 of arm 108. In FIG. 3, electrical switch 116 is mounted on sail member 106.

Still referring to FIG. 2, joint 114 comprises a ball and socket clamp closed by a threaded fastener 109. In the arrangement of FIG. 2, threaded fastener 109 both retains the ball of the ball and socket joint and also adjusts an amount of force imposed on sail member 106 which would be required to overcome friction of the ball and socket joint, thereby enabling sail member 106 and adjustable segment 112 of arm 108 to move responsively to air flow. In FIG. 3, joint 114 comprises a hinge joint. Axial compression enabling sail member 106 and adjustable segment 112 to move responsively to air flow is generated by turning an axial fastener 111. Greater compressive forces increase resistance to moving of sail member 106 and adjustable segment 112.

Sail switch 100 may for practicality provide portions 12B of control circuit 12A. At a minimum, sail switch 100 includes as part of control circuit 12 only switch contacts (not shown) and wire terminals (not shown) of electrical switch 116. Portion 12B of control circuit 12A will be regarded as those portions of the latter which are closely associated with features of sail switch 100. Portion 12B of control circuit 12A may include conductors (not necessarily specifically shown) connecting components of sail switch 100 such as switch contacts and wire terminals which are spaced apart from each other. For example, it would be preferred to locate the wire terminals on a fixed component such as mounting base 104 or fixed segment 110. This opposes inadvertent adjustment of orientation of sail member 106 due to forces arising from connecting wiring of control circuit 102 to sail switch 100 by personnel in the field. In this case, sail switch 100 would include electrical conductors (not shown) electrically connecting the switch contacts to the wire terminals to extend along arm 108. Therefore, some of portion 12B may be factory installed, and some of portion 12B may be installed in the field, depending on specific requirements of any given installation.

Mounting base 104 has holes 118 to accept fasteners 120. In the example of FIG. 1, mounting base 104 comprises a plate which flushly abuts a floor pan 14 of condenser 10. Many of the potential available mounting locations within condenser 10 for sail switch 100 include members which are suitable for drilling holes to accept fasteners 120, floor pan 14 being only one. Different condensers 10 may present support arms and other suitable structure (none shown) for supporting sail switch 100. Referring also to FIG. 2, because floor pan 14 and most support arms and candidate structure for supporting sail switch 100 are fabricated from a magnetically responsive material such as steel, sail switch 100 may comprise a magnet 122 (or several magnets 122) coupled to mounting base 104 in a way enabling magnetic coupling of sail switch 100 to a magnetically responsive environmental object, such as floor pan 14. Magnets 122 may be used to tack sail switch 100 temporarily in a suitable location while drilling holes into the supporting structure or installing fasteners 118 during installation of sail switch 100.

With continued reference to FIG. 2, sail switch 100 may further comprise an angular orientation sensor 124 which senses and annunciates angular orientation of sail member 100 relative to a horizontal direction. Angular orientation sensor 124 may comprise a bubble level device 126 (FIG. 3) for example. Alternatively, as shown in FIG. 3, angular orientation sensor 124 may be electrical or electronic, comprising a variable output electrical device and an associated display (neither separately shown) indicating deviation from the horizontal direction. Angular orientation sensor 124 facilitates installation of sail member 106 in a predetermined orientation. For example, an engineering department of a fabrication facility may predetermine a desired orientation of sail member 106 for any given specific model of condenser 10. Even where sail switch 100 is installed as a retrofit device within a pre-existing condenser 10, there may have been established a specification requiring a particular angle for sail member 106. Providing angular orientation sensor 124 assists installing personnel either in a factory setting or alternatively, in the field, to mount sail switch 100 or sail member 106 appropriately to meet a specification.

Angular orientation sensor 124 may be mounted on adjustable segment 112 of arm 108, as shown in FIG. 2, or alternatively, may be mounted to sail member 106 (the latter is not shown).

Figure 4:
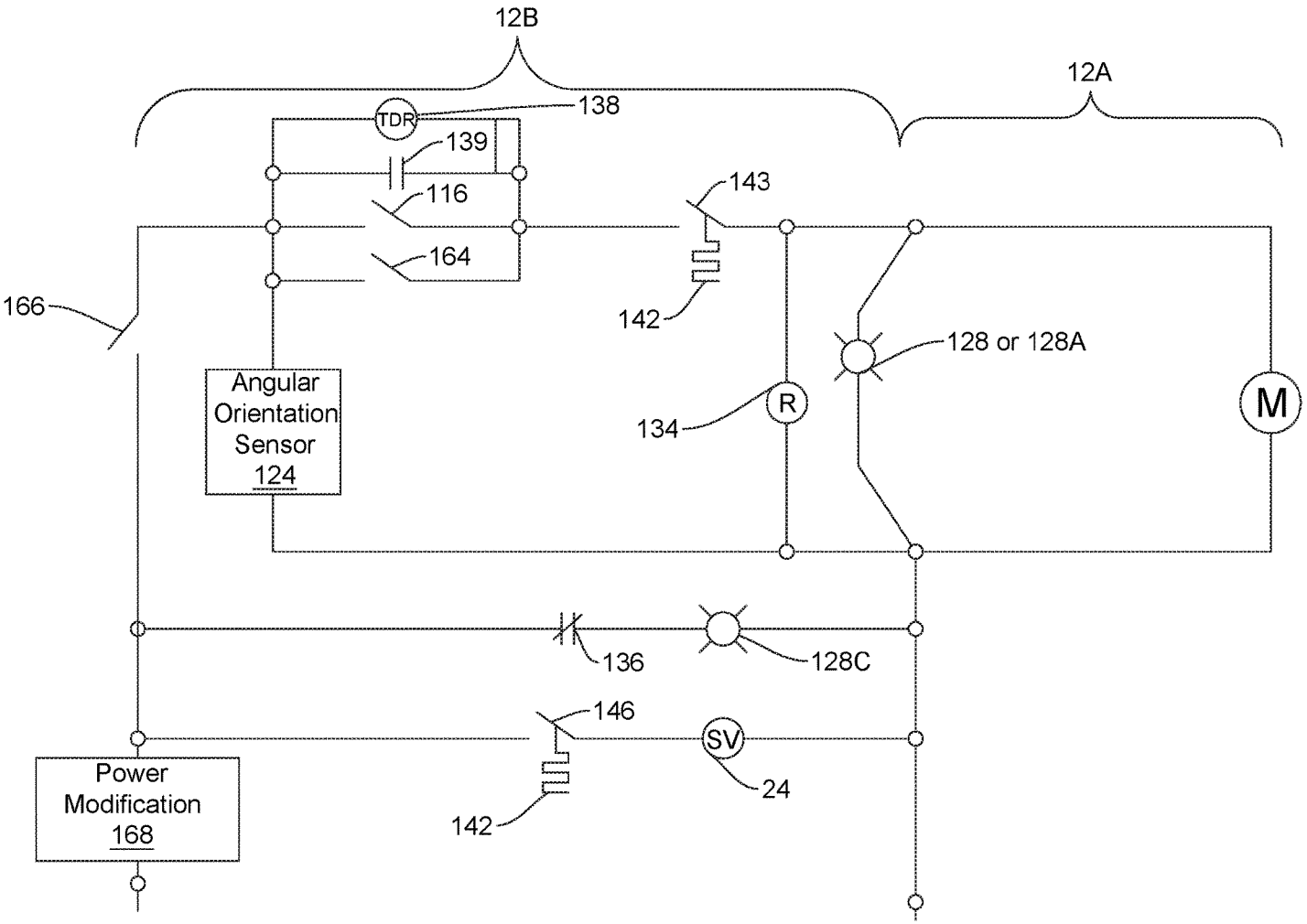
FIG. 4 is an electrical schematic of electrical circuitry of the sail switch and condenser of FIG. 1, which electrical schematic includes optional elements, according to at least one aspect of the invention.
Figure 5:
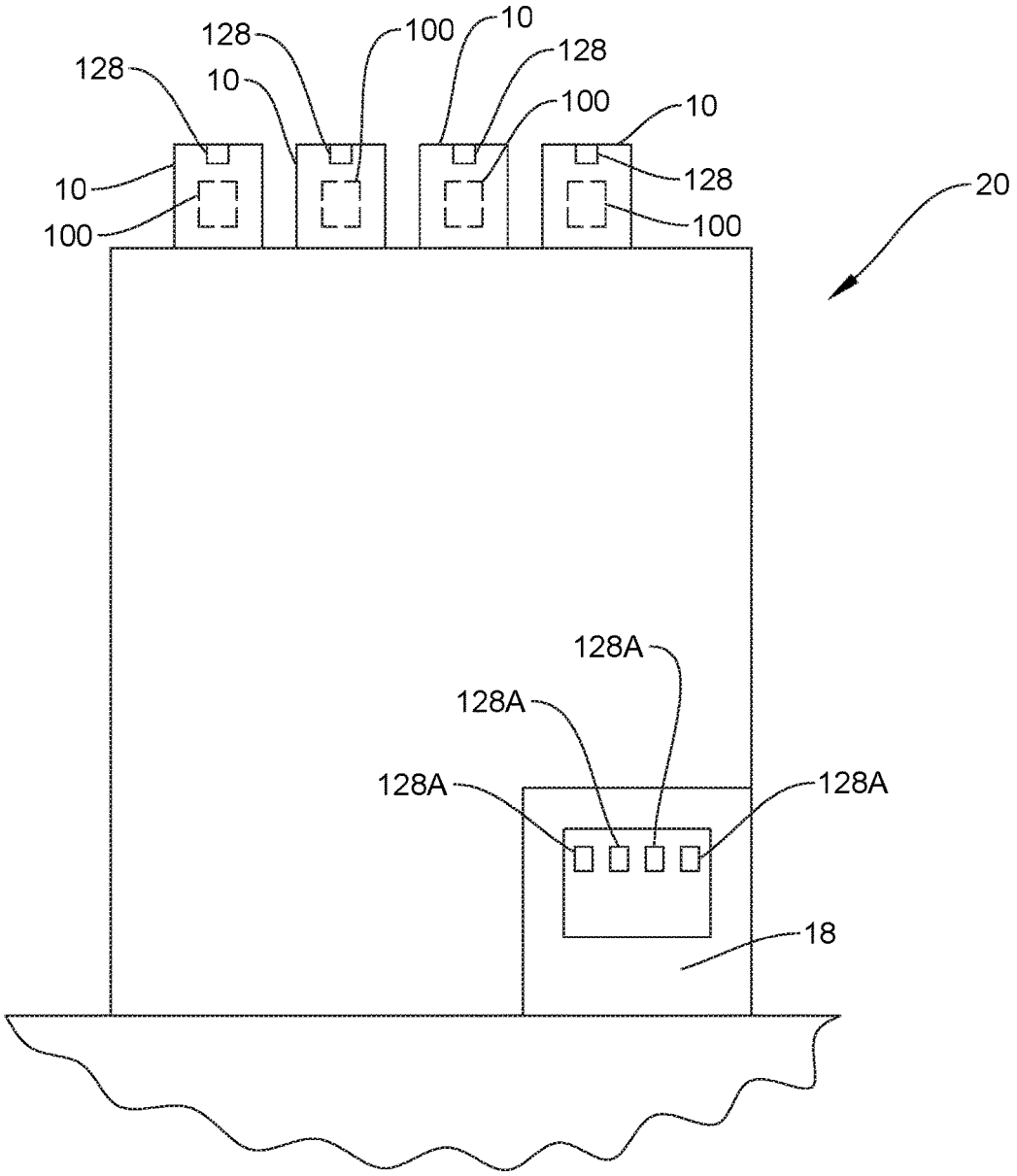
FIG. 5 is a schematic side view of a multi-tenant building incorporating the sail switch of FIG. 1 in a plurality of roof mounted condensers, according to at least one aspect of the invention.

Referring particularly to FIG. 4, sail switch 100 may further comprise a pilot light 128 operably connected to electrical switch 116. Operable connection to electrical switch 116 and arrangement of pilot light 128 imply that additional conductors are connected to portion 12B of control circuit 12A to achieve the described function. Pilot light 128, which may also be called an indicating light, may be arranged to annunciate a closed state of electrical switch 116. Alternatively, pilot light 128 may be arranged to annunciate an open circuit state of electrical switch 116. Referring to FIG. 5, this may be performed by introducing a relay 134 having normally closed contacts 136 into portion 12B of control circuit 12A and connecting operating power from control circuit 12B or from any other suitable source through normally closed contacts 136 to pilot light 128C. Pilot lights 128 and 128A (described hereinafter) indicate a condition in which the motor protected by sail switch 100 is running. Pilot light 128C indicates a condition in which the motor is not currently running, but no fault condition has been detected in control circuit 12A.

Referring to FIGS. 1 and 4, and with particular reference to FIG. 5, sail switch 100 is mounted at an apparatus (i.e., condenser 10). Pilot light 128 is visible from the apparatus. In the example of FIG. 5, there are four condensers 10, each with pilot light 128 mounted externally thereon. As also seen, it is possible that with sail switch 100 mounted at the apparatus, pilot light 128A is remote from and not visible from from the apparatus. In the example of FIG. 5, control circuit 12A extends from condensers 10 to a master annunciator panel 16 located within a utility room 18 (e.g., an electrical equipment room, a mechanical equipment room, or an office occupied by maintenance personnel) of a multi-tenant building 20.

Referring again to FIG. 4, sail switch 100 may comprise a time delay relay 138 connected to electrical switch 116 and arranged to provide circuit continuity such that opening of electrical switch 116 is inhibited from opening electrical control circuit 12A (or portion 12B thereof) for a predetermined time period. Reference to time delay relay 138 as being connected to electrical switch 116 and arranged to provide circuit continuity imply that additional conductors and normally open contacts 139 are connected to portion 12B of control circuit 12A to achieve the described function. Time delay relay 138 may therefore be of a type to be independent of constant connection to power from portion 12B of control circuit 12A, or may be of a different type of relay such as a voltage sensing relay connected to portion 12B at a point not interruptible by electrical switches 116 or 164. As incorporated into control circuit 12A (or portion 12B thereof), this additional circuitry may compensate for, e.g., brief transient conditions which may only temporarily obstruct air flow through condenser 10, or may compensate for hysteresis in response of sail member 106 when responding to increasing air flow.

Referring to FIGS. 2 and 4, sail switch 100 may further comprise a thermostatic device 142 mounted on one of sail member 106 and adjustable segment 112 of arm 108, whereby temperature of air flowing past sail member 106 may be monitored. Thermostatic device 142 of sail switch 100 may further comprise a communications feature arranged to transmit remotely signals corresponding to temperatures sensed by thermostatic device 142. To this end, the communications feature comprises a wireless communications device such as a radio frequency transmitter 144. Thermostatic device 142 may open control circuit 12A, or may transmit a signal remotely for annunciation or to initiate a response remotely. To open control circuit 12A, thermostatic device 142 operates a thermostatic switch 143 (FIG. 4).

Figure 6:
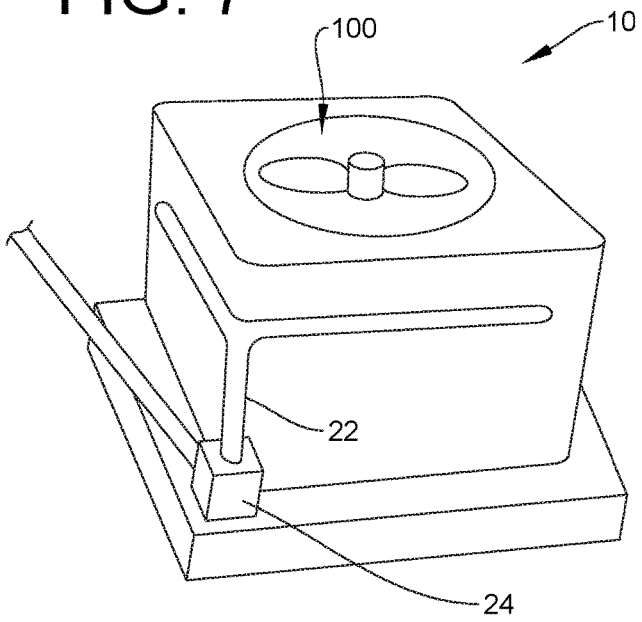
FIG. 6 is an environmental schematic perspective view of a condenser having an optional supplementary cooling feature controlled by the sail switch of FIG. 1, according to at least one aspect of the invention.

Referring to FIGS. 4 and 6, condenser 10 may be provided with a supplementary cooling system such as a water manifold 22 having nozzles or orifices (not separately shown) arranged to discharge water onto condensing cools and heat transfer fins (neither separately shown) of condenser 10. The supplementary cooling system may include an solenoid valve 24 enabling water under pressure from the domestic water supply to enter water manifold 22. Sail switch 100 may further comprise a supplementary cooling actuator for operating the supplementary cooling system. Electrical conductors added to portion 12B of control circuit 12A to electrically connect thermostatic device 142 to solenoid valve 24 using a thermostatic switch 146 which closes when temperatures sensed by thermostatic device 142 exceed a predetermined threshhold may be regarded as the supplementary cooling actuator. Alternatively, the supplementary cooling actuator may be regarded as encompassing solenoid valve 24.

Figure 7:
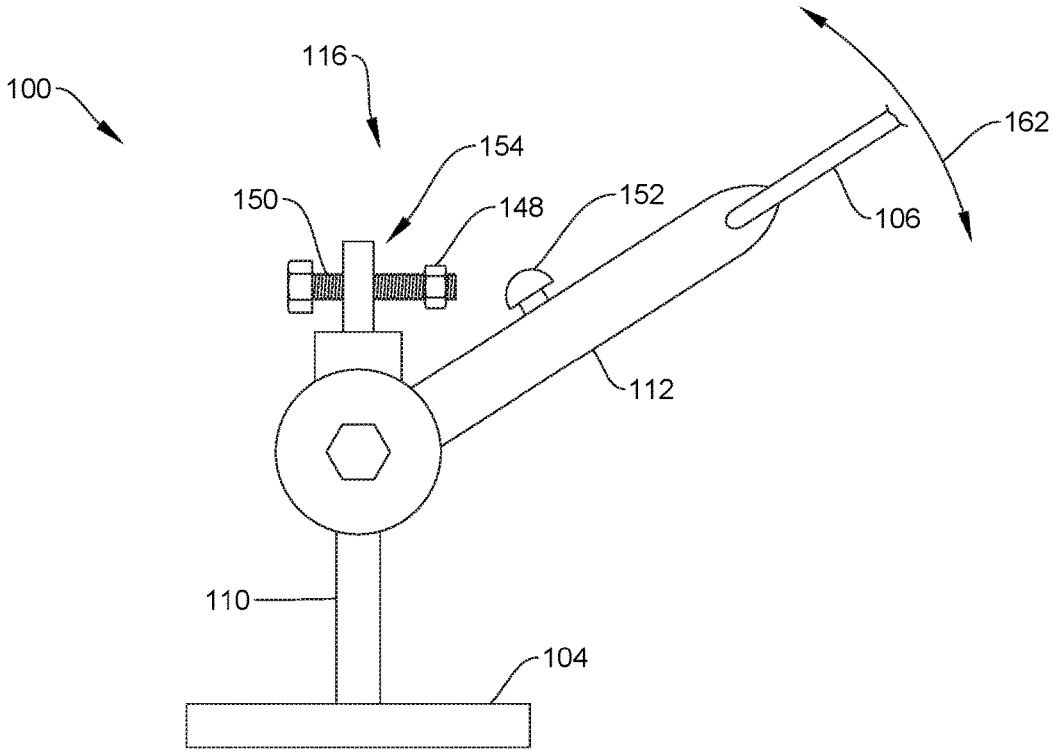
FIG. 7 is a schematic side detail view of an optional construction of the sail switch of FIG. 1, according to at least one aspect of the invention.

Sail switch 100 may further comprise a switch loading adjustment feature arranged to adjust force required to displace sail member 106 at any given rate of air flow. The switch loading adjustment feature may comprise an adjustable resistance arrangement which modifies response of sail member 106 and adjustable segment 112 of arm 108 to air flow. An example is axial fastener 111, described priorly, which adjusts tension resisting arm travel of sail member 106. Turning now to FIG. 7, another switch loading adjustment feature is shown, wherein a first contact 148 of electrical switch 116 is fixed to a screw shaft 150 supported on a journal 154 on fixed segment 110 of arm 108. A second contact 152 of electrical switch 116 is mounted to adjustable segment 112 of arm 108. Turning screw shaft 150 adjusts an initial distance separating first and second contacts 148, 152, so that more or less displacement of sail member 106 is required to effect switch closure of electrical switch 116 from an initial location of sail member 106.

Turning now to FIG. 3, sail switch 100 may further comprise a switch arm travel adjustment feature which constrains a range of travel of sail member 106 to predetermined values. An adjustment screw 156 passes through adjustable segment 112 of arm 108 and threads to a tab 158 fixed to fixed segment 110 of arm 110. Turning adjustment screw 156 raises and lowers a stop 160, thereby increasing and decreasing the amount of unconstrained travel of adjustable segment 112 as it swings arcuately (indicated as arrow 162).

Description of adjustment screw 156 raising and lowering stop 160 reflects how FIG. 3 has been drawn. It should be noted at this point that orientational terms such as raising and lowering refer to the subject drawing as viewed by an observer. The drawing figures depict their subject matter in orientations of normal use, which could obviously change with changes in mounting orientation and position. Therefore, orientational terms must be understood to provide semantic basis for purposes of description only, and do not imply that their subject matter can be used only in one position.

Again referring to FIG. 4, sail switch 100 may further comprise a control signal on-off switch arranged to maintain continuity of portion 12B of control circuit 12A regardless of whether electrical switch 116 is open or closed. Arranging the control signal on-off switch to maintain continuity of portion 12B implies that additional conductors are added to portion 12B to achieve this function. Control signal on-off switch may be a manual toggle switch 164 located in portion 12B which overrides electrical switch 116, as shown in FIG. 4.

Sail switch 100 may further comprise a control signal on-off switch arranged to break continuity of portion 12B of control circuit 12A regardless of whether electrical switch 116 is open or closed. Control signal on-off switch may be a manual toggle switch 166 located in portion 12B as shown in FIG. 4.

Because different electrical components operate at different voltages, and on either AC power or DC power, a power modification device 168 may be connected to portion 12B of control circuit 12A.

Sail switch 100 may further comprise a transformer electrically connected to control circuit 12A (or portion 12B thereof), for providing auxiliary power at a voltage different from that of control circuit 12A. Where this is desired, power modification device 168 is a transformer.

Sail switch 100 may further comprise a DC to AC inverter electrically connected to the control circuit, for providing auxiliary AC power from the control circuit in cases where the control circuit operates on DC power. Where this is desired, power modification device 168 is a DC to AC inverter.

Sail switch 100 may further comprise an AC to DC converter electrically connected to portion 12B of control circuit 12A, for providing auxiliary DC power from control circuit 12A in cases where control circuit 12A operates on AC power. Where this is desired, such as to operate pilot light 128 or 128A as an LED, power modification device 168 is an AC to DC converter.

Although the example of FIGS. 1-9 refers to condenser 10, sail switch 100 may be used with other types of equipment, such as air cooled equipment (e.g., cooling towers), to monitor fan operation, and for environmental condition sensing (e.g., wind). Although described in terms of monitoring air flow, sail switch 100 could be used with flow of other gases, and in liquid environments to sense liquid flow.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. A sail switch for sensing air flow and responsively opening and closing a control circuit, comprising:

a mounting base comprising a plate that flushly abuts a floor pan of a condenser;

a magnet coupled to the mounting base, so as to couple the sail switch to a magnetically responsive environmental object;

a sail member;

an angular orientation sensor which senses and indicates angular orientation of the sail member relative to a horizontal direction;

a switch loading adjustment means arranged to adjust force required to displace the sail member at any given rate of air flow;

a switch arm travel adjustment means which constrains a range of travel of the sail member to predetermined values, wherein the switch arm travel adjustment means comprises a screw;

an arm supporting the sail member to the mounting base at a predetermined orientation thereto, the arm including a fixed segment comprising a tab fixed to the fixed segment to accommodate the screw of the switch arm travel adjustment means, an adjustable segment, and a joint between the fixed segment and the adjustable segment, wherein the joint is configured to permit the sail member to be raised and lowered away and towards the mounting base and the floor pan of the condenser in an arcuate orientation such that the sail member arcuately extends at least parallel to the mounting base and the floor pan;

an electrical switch mounted on one of the adjustable segment of the arm and the sail member, whereby the control circuit may be electrically connected to and controlled by the sail switch;

a time delay relay connected to the electrical switch and configured to provide circuit continuity such that opening of the electrical switch is inhibited from opening the electrical control circuit for a predetermined time period; and a control signal on-off switch configured to maintain continuity of the control circuit regardless of whether the electrical switch is open or closed.

2. The sail switch of claim 1, wherein the mounting base has mounting holes to accept fasteners.

3. The sail switch of claim 1, further comprising a pilot light operably connected to the electrical switch.

4. The sail switch of claim 3, wherein the pilot light indicates a closed circuit state of the electrical switch.

5. The sail switch of claim 3, wherein the pilot light indicates an open circuit state of the electrical switch.

6. The sail switch of claim 3, wherein the sail switch is mounted in an apparatus, and the pilot light is visible from the apparatus.

7. The sail switch of claim 3, wherein the sail switch is mounted in an apparatus, and the pilot light is remote from and not visible from the apparatus.

8. The sail switch of claim 1, further comprising a thermostatic device mounted on one of the sail member and the adjustable segment of the arm, whereby temperature of air flowing over the sail member may be monitored.

9. The sail switch of claim 8, further comprising a communications means configured to transmit signals corresponding to temperatures sensed by the thermostatic device.

10. The sail switch of claim 9, wherein the communications means comprises a wireless communications device.

11. The sail switch of claim 8, further comprising a supplementary cooling actuator for operating a supplementary cooling system, wherein the supplementary cooling actuator is electrically connected to the thermostatic device.

12. The sail switch of claim 1, further comprising a control signal on-off switch configured to break continuity of the control circuit regardless of whether the electrical switch is open or closed.

13. The sail switch of claim 1, further comprising a transformer electrically connected to the control circuit, for providing auxiliary power at a voltage different from that of the control circuit.

14. The sail switch of claim 1, further comprising a DC to AC inverter electrically connected to the control circuit, for providing auxiliary AC power from the control circuit in cases where the control circuit operates on DC power.

15. The sail switch of claim 1, further comprising an AC to DC converter electrically connected to the control circuit, for providing auxiliary DC power from the control circuit in cases where the control circuit operates on AC power.

16. A sail switch for sensing air flow and responsively opening and closing a control circuit, comprising:

a mounting base comprising a plate that flushly abuts a floor pan of a condenser;

a magnet coupled to the mounting base, so as to couple the sail switch to a magnetically responsive environmental object;

a sail member;

an angular orientation sensor which senses and indicates angular orientation of the sail member relative to a horizontal direction;

a switch loading adjustment means arranged to adjust force required to displace the sail member at any given rate of air flow;

a switch arm travel adjustment means which constrains a range of travel of the sail member to predetermined values, wherein the switch arm travel adjustment means comprises a screw;

an arm supporting the sail member to the mounting base at a predetermined orientation thereto, the arm including a fixed segment comprising a tab fixed to the fixed segment to accommodate the screw of the switch arm travel adjustment means, an adjustable segment, and a joint between the fixed segment and the adjustable segment, wherein the joint is configured to permit the sail member to be raised and lowered away and towards the mounting base and the floor pan of the condenser in an arcuate orientation such that the sail member arcuately extends at least parallel to the mounting base and the floor pan;

a thermostatic device mounted on one of the adjustable segment of the arm and the sail member, whereby temperature of air flowing over the sail member may be monitored;

a communications means configured to transmit signals corresponding to temperatures sensed by the thermostatic device;

an electrical switch mounted on one of the adjustable segment of the arm and the sail member, whereby the control circuit may be electrically connected to and controlled by the sail switch;

a time delay relay connected to the electrical switch and configured to provide circuit continuity such that opening of the electrical switch is inhibited from opening the electrical control circuit for a predetermined time period; and a control signal on-off switch configured to maintain continuity of the control circuit regardless of whether the electrical switch is open or closed.

17. The sail switch of claim 16, wherein the communications means comprises a wireless communications device.

18. A sail switch for sensing air flow and responsively opening and closing a control circuit, comprising:

a mounting base comprising a plate that flushly abuts a floor pan of a condenser;

a magnet coupled to the mounting base, so as to couple the sail switch to a magnetically responsive environmental object;

a sail member;

an angular orientation sensor which senses and indicates angular orientation of the sail member relative to a horizontal direction;

a switch loading adjustment means arranged to adjust force required to displace the sail member at any given rate of air flow;

a switch arm travel adjustment means which constrains a range of travel of the sail member to predetermined values, wherein the switch arm travel adjustment means comprises a screw;

an arm supporting the sail member to the mounting base at a predetermined orientation thereto, the arm including a fixed segment comprising a tab fixed to the fixed segment to accommodate the screw of the switch arm travel adjustment means, an adjustable segment, and a joint between the fixed segment and the adjustable segment, wherein the joint is configured to permit the sail member to be raised and lowered away and towards the mounting base and the floor pan of the condenser in an arcuate orientation such that the sail member arcuately extends at least parallel to the mounting base and the floor pan;

an electrical switch mounted on one of the adjustable segment of the arm and the sail member, whereby the control circuit may be electrically connected to and controlled by the sail switch;

a time delay relay connected to the electrical switch and configured to provide circuit continuity such that opening of the electrical switch is inhibited from opening the electrical control circuit for a predetermined time period;

a control signal on-off switch configured to maintain continuity of the control circuit regardless of whether the electrical switch is open or closed; and an electrical inverter electrically connected to the control circuit for providing auxiliary power from the control circuit, wherein the mounting base has mounting holes to accept fasteners.

19. The sail switch of claim 18, wherein the electrical inverter comprises a DC to AC inverter for providing auxiliary AC power from the control circuit in cases where the control circuit operates on DC power.

20. The sail switch of claim 18, wherein the electrical inverter comprises an AC to DC converter for providing auxiliary DC power from the control circuit in cases where the control circuit operates on AC power.

* * * * *